US008590355B2

(12) United States Patent
Flanhardt et al.

(10) Patent No.: US 8,590,355 B2
(45) Date of Patent: Nov. 26, 2013

(54) CHOPPING BLADE AND COUNTERBLADE FOR A CHOPPING DEVICE AND PROCESS FOR ITS PRODUCTION

(75) Inventors: Michael Flanhardt, Langenfeld (DE); Karlfried Platz, Soligen (DE); Manfred Gröning, Dortmund (DE); Heinz-Günter Schumacher, Eichelhardt (DE); Gerd Bernhardt, Baunewitz (DE); André Heinrich, Otterwisch (DE); Andreas Acimas, Solingen (DE)

(73) Assignee: Rasspe Systemtechnik GmbH & Co. KG, Solingen (DE)

( * ) Notice: Subject to any disclaimer, the term of this patent is extended or adjusted under 35 U.S.C. 154(b) by 2080 days.

(21) Appl. No.: 11/104,168

(22) Filed: Apr. 11, 2005

(65) Prior Publication Data

US 2005/0230510 A1 Oct. 20, 2005

(30) Foreign Application Priority Data

Apr. 19, 2004 (DE) ..... 10 2004 019 378

(51) Int. Cl.
*B21B 1/00* (2006.01)

(52) U.S. Cl.
USPC ..... 72/203

(58) Field of Classification Search
USPC ..... 72/203, 240; 76/115, 116, 104.1; 451/45
See application file for complete search history.

(56) References Cited

U.S. PATENT DOCUMENTS

| | | | | | |
|---|---|---|---|---|---|
| 3,021,737 | A * | 2/1962 | Titze | 72/366.2 |
| 3,741,046 | A * | 6/1973 | Chambon | 76/104.1 |
| 4,141,260 | A * | 2/1979 | Bertini | 76/25.1 |
| 4,503,893 | A * | 3/1985 | Demopoulos | 144/176 |
| 4,920,652 | A * | 5/1990 | Johnson | 30/504 |
| 5,115,663 | A * | 5/1992 | Ando et al. | 72/369 |
| 5,592,845 | A * | 1/1997 | Gerenser et al. | 72/161 |
| 5,645,470 | A * | 7/1997 | Ludwig | 451/45 |
| 6,325,575 | B1 * | 12/2001 | Pawlik | 408/83.5 |
| 6,644,086 | B1 * | 11/2003 | Bodnar | 72/181 |

FOREIGN PATENT DOCUMENTS

| | | |
|---|---|---|
| DE | 580579 | 7/1933 |
| DE | 36 26 456 C2 | 8/1986 |
| DE | 94 16 851.2 | 10/1994 |
| EP | 0 538 599 B1 | 9/1932 |
| EP | 0 415 419 A2 | 8/1990 |
| WO | WO 97/48508 A1 | 12/1997 |

OTHER PUBLICATIONS

German Search Report, Nov. 23, 2004.

* cited by examiner

*Primary Examiner* — Teresa M Ekiert
(74) *Attorney, Agent, or Firm* — Fay Sharpe LLP

(57) ABSTRACT

Cutting blades and counterblades are presented having long edge life for chopping devices equipped with blades mounted on rotating drums and with counterblades which fit into the gaps between the blades, the blades and/or counterblades being produced by rolling at least one of the longitudinal edges of a piece of flat strip material to form a slightly rounded, prismatic cutting edge, the rolling being continued until satisfactory sharpness is obtained.

21 Claims, 8 Drawing Sheets

FIG. 10A
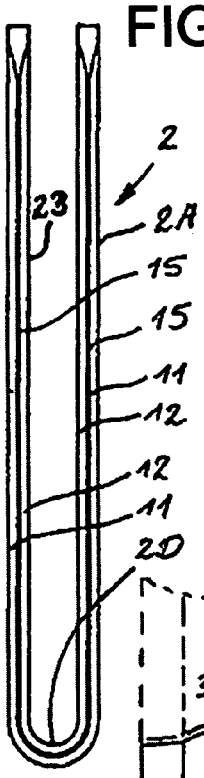
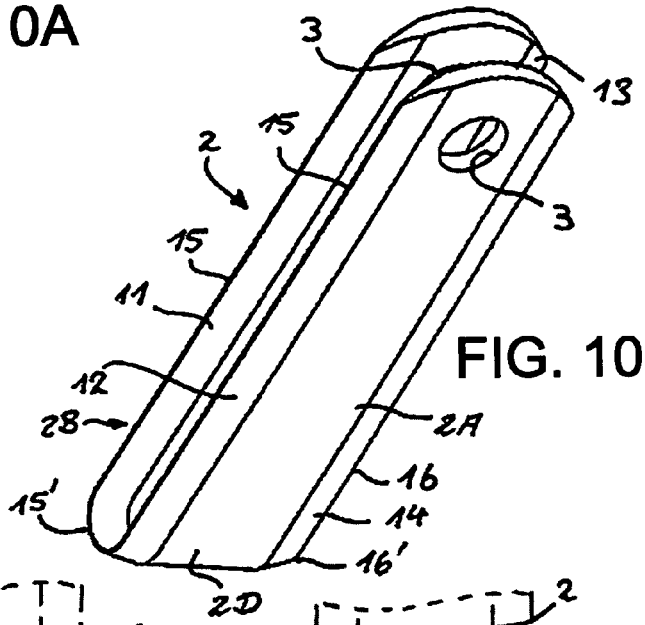
FIG. 10B
FIG. 11A
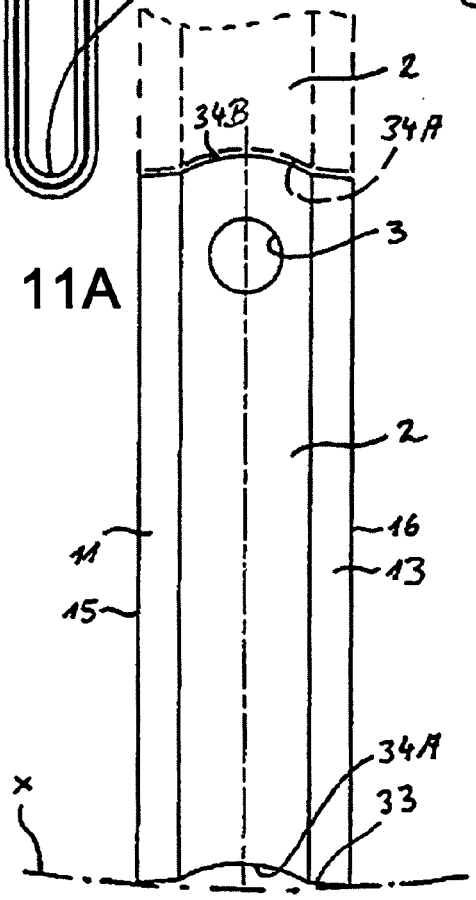
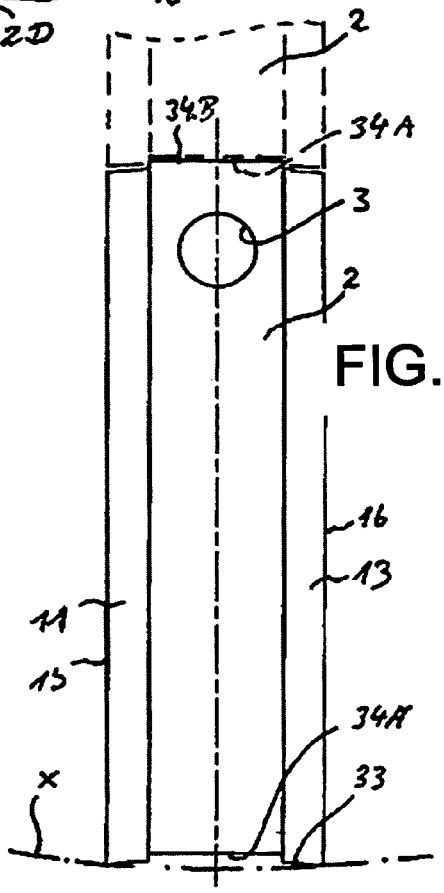
FIG. 11B

CHOPPING BLADE AND COUNTERBLADE FOR A CHOPPING DEVICE AND PROCESS FOR ITS PRODUCTION

CROSS-REFERENCE TO RELATED APPLICATIONS

This application claims priority to and the benefit of German Patent Application No. DE102004019378.9, filed Apr. 19, 2004, the entirety of which is hereby incorporated by reference as if fully set forth herein.

FIELD OF THE INVENTION

The invention relates to chopping blades and counterblades for a chopping device and methods for production thereof.

BACKGROUND OF THE INVENTION

Blades and counterblades are used in various chopping devices, such as devices for cutting straw and similar materials into small pieces. These devices are used in combine-harvesters, for example. They are equipped with a rotating roll or drum, on which a plurality of chopping blades are mounted in a fixed or rotating manner, distributed both over the length of the drum and also around its circumference. These devices chop up the material supplied for chopping between stationary counterblades. The chopped material is transported onward by appropriate guide devices. DE-PS 3,626,456 describes blades with rectangular cross sections, which have cutting edges ground along on their long sides. These cutting edges extend over approximately three-fourths of the length of the blade or possibly over its entire length. EP 0,538,599 and DE-U-94-16,851 describe blades with teeth which have been ground into the cutting edges. Because the cutting edges are produced by grinding, the stress which occurs when load is exerted on the blades is diffused unfavorably. This unfavorable stress diffusion increases the likelihood that the cutting tools will be bent out of shape and is attributable to the metal-removing method used to create the beveled surfaces—a method which not only forms grooves in the surface of the bevels and thus promotes the notch effect but also interrupts the course of the fibers or texture of the blade, which is usually manufactured from strip material. The service life and strength of such blades have a major determining effect on the reliability of the chopping device, which operates without vibration only when the rotating drum is equipped with cutting tools of uniform weight. If, for example, a broken blade must be replaced, the blade mounted on the opposite side of the drum must also be replaced in order to restore the necessary balance.

SUMMARY OF THE INVENTION

The invention provides a chopping blade for chopping devices and a production process for such blades, by means of which the edge life and resistance to bending, twisting, and breaking are significantly improved. Chopping blades are preferably manufactured within extremely narrow weight limits, and it is desirable that the process by which the blades are manufactured be reliable and consistent.

One aspect of the present invention provides a process for the production of blades for chopping devices for cutting straw and the like having rotating drums on which the blades are mounted in a stationary or rotating manner, in which at least one of the longitudinal edges of a strip of flat steel or other starting material is rolled into a prismatic shape with a slightly rounded prismatic cutting edge to obtain satisfactory sharpness.

Another aspect of the invention provides a chopping blade for chopping devices equipped with rotating drums on which blades are mounted in a stationary or rotating manner. The blade comprises a section of flat steel or other material with a fastening zone such as a hole, and a prismatic cutting edge. The blade can be provided with serrations, extending at least along one of the longitudinal edges, wherein the prismatic cutting edge has a rolled texture extending over at least part of the length of the longitudinal edge, with the rolled surface zone forming a prismatic arrangement.

Yet another aspect of the invention provides a counterblade for cutting devices equipped with rotating drums on which blades are mounted in either stationary or rotating fashion in an axial gap thereof. The counterblade comprises a piece of flat steel or other material with a fastening zone such as a hole, and a prismatic cutting edge that may include serrations, extending along at least a portion of a longitudinal edge of the strip, where the prismatic cutting edge has a rolled texture extending over at least part of the length of the longitudinal edge, the rolled surface zone forming a prismatic arrangement.

Blades for chopping devices do not have to be especially sharp, but they are preferably long-lasting and as strong as possible. To achieve this goal in the past, the longitudinal edges of the blades were ground into a prismatic shape, and then the blade as a whole was hardened. It has been found that the need to grind the entire blade can be eliminated by producing the prismatic cutting edges by a non-cutting process such as rolling in accordance with the invention. A slightly rounded but sufficiently sharp and strong cutting edge can thus be obtained. Cutting edges made in this way do not crack and thus do not fracture, in contrast to the blades which are produced by grinding or some other material-removing process.

According to certain implementations of the invention, the cutting tools are preferably produced from strip material, such as a form of flat steel. The lateral (longitudinal) edges of the strip material are beveled on one or both sides preferably by cold-rolling, which is a process which does not involve any cutting. The bevels can be arranged in various ways, with the result that blades can assume prismatic cross sections in the form of trapezoids, parallelograms, double wedges, etc. Bevels of unequal length and combinations of different profiles, for example, can be used to obtain even more cross-sectional forms.

In an advantageous implementation of the invention, the cutting edge is provided with a radius of about 0.3 mm or less. As a result of this measure, the cutting edge is less sensitive to damage from foreign bodies than a sharply ground edge is. The service life of an edge rounded in this way is also increased. A sharp edge becomes rounded in any case after a short period of operation. In addition, the cutting edges of the rotating blades continue to travel forward under centrifugal force as the drum of the chopper slows to a stop and thus strike the cylindrical surface of the drum. The force of this impact is distributed much more favorably along a rounded edge of the previously described type than it is along an edge which has been set back by grinding.

If, as is preferred, the longitudinal edges of the flat steel are rolled along the entire length of the flat piece, the forming process is very economical. In addition, the rolled texture thus produced increases the edge strength of the blade over its entire length.

Chopper blades preferably fall within extremely narrow weight tolerances on the order of ±1 g per meter. Considerable effort was previously required to accomplish this very difficult task when the cutting edges were produced by grinding. It has been found, however, that when the cutting edges are rolled according to the invention to produce satisfactory sharpness, it may be difficult to remain within these narrow weight tolerances while avoiding the risk of insufficient rolling. According to an elaboration of the invention, therefore, various steps—either individually or in combination with each other—are proposed: By subjecting the longitudinal edges of a starting material with a rectangular cross section to a cutting operation before they are formed into prismatic cutting edges by rolling, it is possible not only to obtain smooth cut edges, which is advantageous for the following rolling step, but also to correct inaccuracies in the cross section of the starting material, which makes it easier to remain within the required weight limits. This is especially true when the starting material is produced from so-called wide flat strip steel by splitting in the longitudinal direction. The step of cutting the longitudinal edges can thus serve both to clean up the edges and to adjust the cross-sectional volume.

To obtain high-quality prismatic cutting edges by rolling them until they are sufficiently sharp, it is especially advantageous first to edge-roll the longitudinal edges of the starting material with a rectangular cross section to smooth them. This results in a significant improvement in the microstructure of the cutting edge.

To keep the weight and especially the cross-sectional volume within the narrow limits required for rotating chopping blades, it is especially advantageous to install width-calibrating rolls between the successive pairs of profiling rolls which roll the prismatic shapes into the longitudinal edges until they are sufficiently sharp. This width calibration controls the material flow between successive pairs of profiling rolls in a manner which promotes the formation of high-quality, rounded cutting edges.

The wear behavior of the inventive chopping blades can also be improved—separately or in combination with the above mentioned features of rolling flat steel into a prismatic shape with a slightly rounded cutting edge—by inserting at least one hard metal piece into the cutting edge. Chopping blades designed in this way have independent inventive status. The hard metal insert does not necessarily have to have cutting edges which participate actively in the chopping process. When a hard metal insert of this type is located near the free end of the chopping blade, a significant wear-reducing effect is produced for the entire cutting edge, because it is at this point that hard foreign bodies such as small stones cause the greatest stress. These hard-metal cutting plates are usually wider than the cutting edge and are therefore especially effective at flinging foreign bodies away. Because of their width, these hard-metal inserts also have an advantageous effect on the degree to which the surface of the material to be chopped is destroyed.

When, according to another elaboration of the invention, several cutting blades are combined into a cutting blade package, a cutting blade of greater overall thickness is obtained, comprising several more-or-less parallel cutting edges. An arrangement such as this, which can also be used with or without the above mentioned features of rolling flat steel into a prismatic shape with a slightly rounded cutting edge, leads not only to more effective size reduction of the material to be chopped but also in particular to better destruction of, or at least damage to, the outer skin layers or cell structures of the material to be chopped. This has the result, for example, of increasing the rate at which the chopped material decays.

A stamping step which might be performed to profile the cross section of the blade and thus to stiffen it in the longitudinal direction is preferably carried out after the prismatic cutting edges have been rolled. Any bends in the longitudinal edges which may have been caused by the stamping will therefore be unable to exert a disadvantageous effect on the rolling process.

Production according to the inventive process becomes especially economical when appropriately profiled rolls are used to roll the prismatic cutting edges continuously along one longitudinal edge or preferably along both longitudinal edges of the strip steel and when the chopping blades are produced by cutting off sections of suitable length and by subjecting these cut-off sections to further processing.

Overall, therefore, the invention provides chopping blades with longitudinal edges having prismatic cutting edges of satisfactory sharpness over their entire length and eliminates both the need for an energy-intensive and time-consuming grinding operation and the textural damage caused by such grinding.

The invention described above is applicable not only to the moving chopping blades on rotating drums but also to the counterblades which fit into the axial gaps between these moving blades. The invention thus also pertains to the chopping device as such.

Seen as a whole, the invention therefore also solves the difficulties caused by contradictory requirements. Profile-rolling to obtain satisfactory sharpness eliminates the need to grind the cutting edges and avoids the associated structural damage to the area of the cutting edge. At the same time, chopping blades can be obtained within very narrow weight tolerances even without the corrective measure known according to the state of the art, namely, the grinding of the cutting edges.

The previously described features to be used according to the invention as claimed and described in the exemplary embodiments are not subject to any special exclusionary conditions with respect to their size, shape, material selection, or technical conception, which means that the selection criteria known for the area of application can be used without limitation.

BRIEF DESCRIPTION OF THE DRAWINGS

Additional details, features, and advantages of the objects of the invention can be derived from the claims and from the following description of the associated drawings, wherein FIGS. 3-11B show by way of example preferred exemplary embodiments of inventive chopping blades and counterblades, in which drawings:

FIG. 3 shows a perspective view of an exemplary chopping blade according to the invention with two cutting edges formed by cold-working or rolling;

FIG. 4A to FIG. 4F show six cross sections through chopping blades with bevels produced by cold or hot-working or rolling;

FIG. 6 shows a cross-sectional view (ground section) of an inventive, prismatic cutter formed by rolling to produce satisfactory sharpness with a slightly rounded cutting edge with a cutting edge radius of approximately 0.25 mm;

FIG. 7 shows a perspective view (a), a top view (b), and an end view (c) of a chopping blade 2 including two chopping blades 2A and 2B;

FIG. 8 shows another top view (a), a side view (b) of an assembly without a gap, a side view (c) of assembly with a gap, and an end view without (d) and with (e) a gap;

FIG. 9 shows an end view of part of a chopping device with stationary and moving blades in the form of chopping blade packages;

FIGS. 10A and 10B show a top view (FIG. 10A) and a perspective view (FIG. 10B) of the cutting edges of a double-edged chopping blade in the shape of a "U"; and FIGS. 11A and 11B show top views of two additional chopping blades with an end surface similar to an undercut.

DETAILED DESCRIPTION OF THE INVENTION

Figure 1:
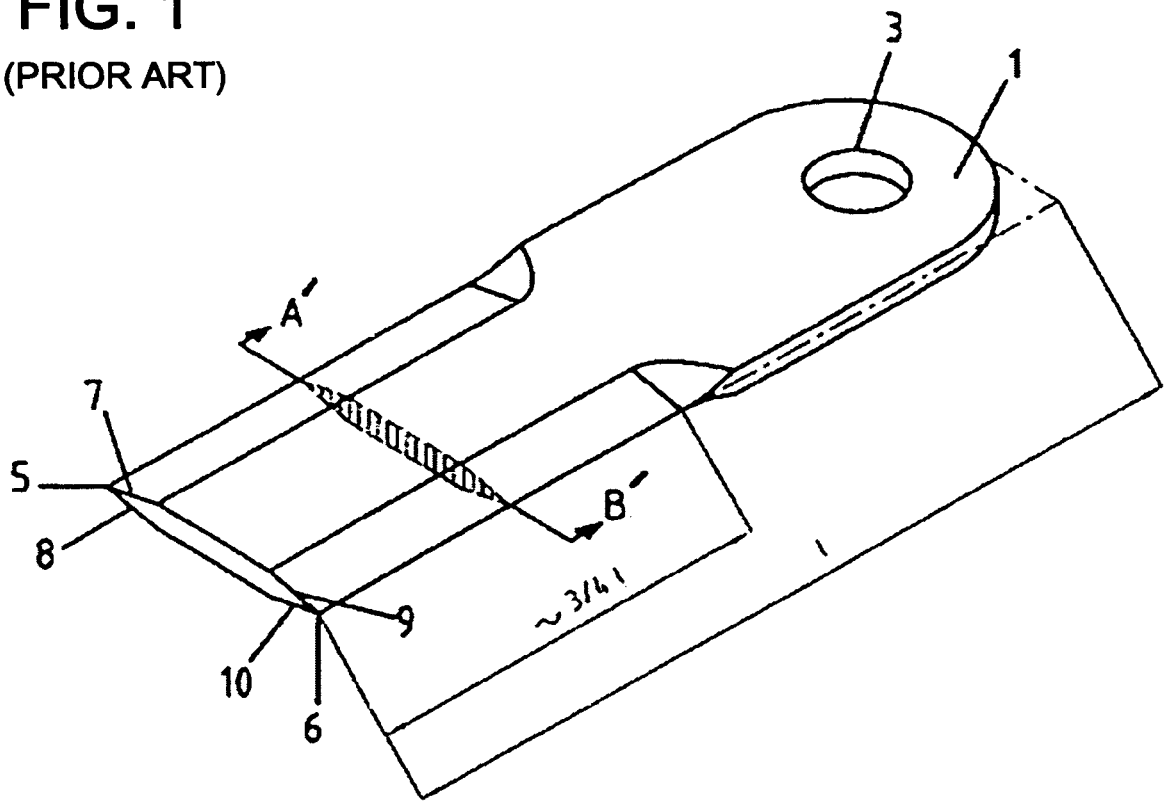
FIG. 1 (PRIOR ART)
FIG. 1 shows a perspective view of a chopping blade according to the state of the art with two ground cutting edges.
Figure 2:
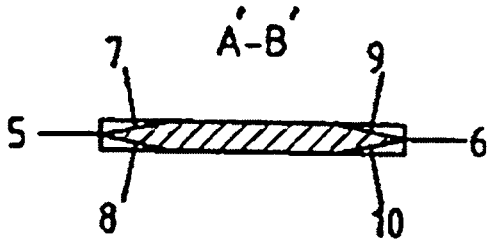
FIG. 2 (PRIOR ART)
FIG. 2 shows the cross section A'-B' through the blade according to FIG. 1.
Figure 3:
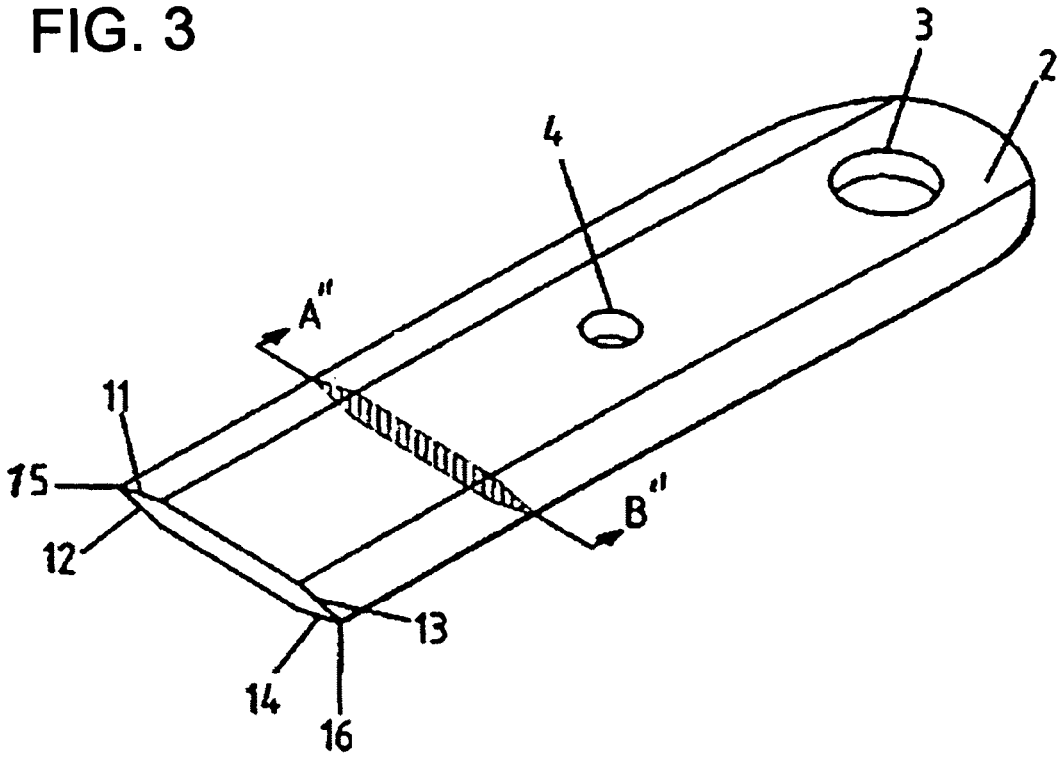

FIGS. 1-3 show perspective views of chopping blades 1 and 2 having fastening zones with corresponding circular openings 3 which allow them to be fastened in place with freedom to swing, as well as longitudinal edges having cutting edges formed at least partially therein. If the blade 2 is to be mounted so that it cannot swing, i.e., so that it remains in a fixed position, a second circular opening 4 (FIG. 3) may be provided. The conventional blade 1 shown in FIGS. 1 and 2 has two cutting edges 5 and 6, which extend over approximately three-quarters of the overall length of the blade. These cutting edges are formed by the beveled grinds 7, 8 and 9, 10.

Figure 4:
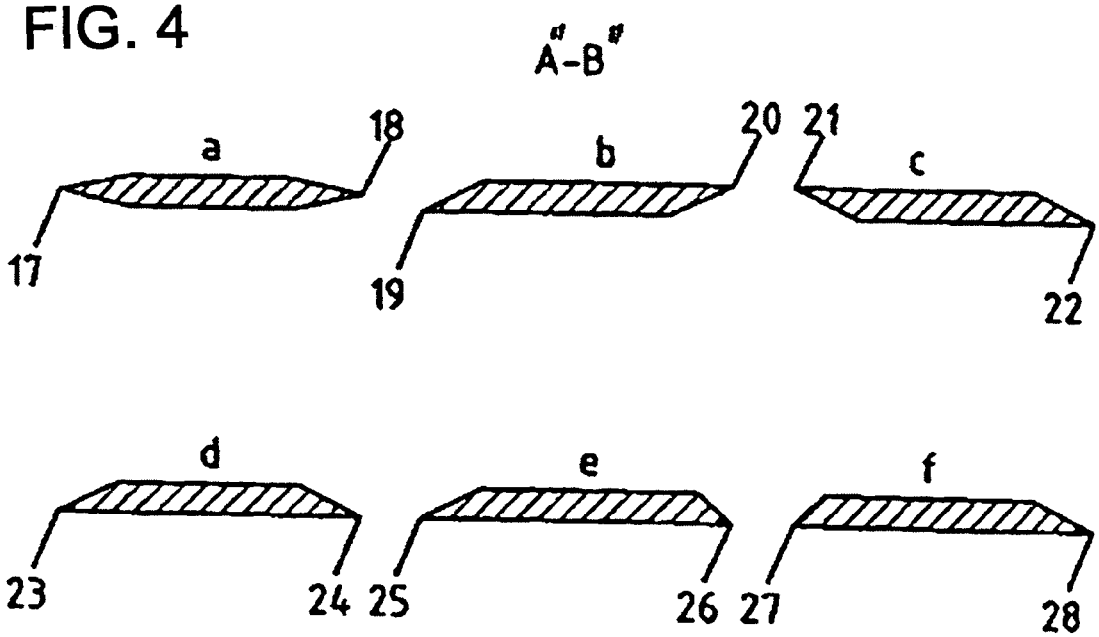
Figure 5A:
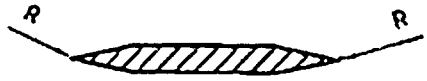
FIG. 5A shows a double wedge-shaped cross section of a chopping blade with beveled surfaces produced by cold or hot rolling and with rounded cutting edges produced without stamping.

In accordance with one or more aspects of the invention, the exemplary blade 2 in FIG. 3 has beveled surfaces 11, 12 and 13, 14, produced by cold or hot-working, which surfaces form cutting edges 15, 16 forming a prismatic cutting edge of satisfactory sharpness. The beveled surfaces 11, 12 and 13, 14 extend over the entire length of the blade although this is not a requirement of the invention. The blade 2 thus comprises a section of flat material, such as steel, with a fastening zone and one or more prismatic cutting edges 15, 16 extending at least partially along a longitudinal edge of the flat strip of steel material, where the prismatic cutting edges 15, 16 have rolled textures extending over at least part of the length of the longitudinal edge in which the rolled surface zones each form a prismatic arrangement. Each of the cutting edges 15, 16 (FIG. 5A) has a rounding R. The blade cross sections a-f shown in FIG. 4 also have rounded cutting edges 17-28, but because of their small size, these roundings cannot be seen in sections a-f of FIG. 4. The blade 2 may also comprise a hardening texture superimposed on the longitudinal edges and/or in the rolled texture.

Figure 5B:
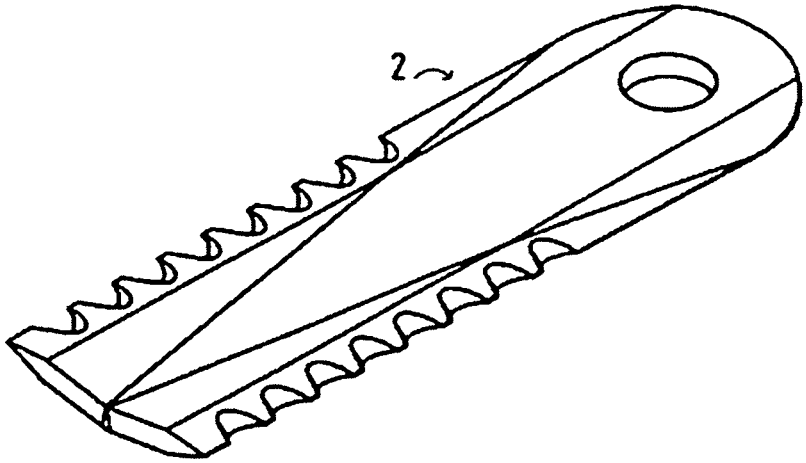
FIG. 5B shows a perspective view of another chopping blade having rolled prismatic cutting edges produced with stamping.

A chopping blade 2 which has been stamped longitudinally to stiffen it can be seen in FIG. 5B. Serrations have also been ground into the prismatic cutting edges.

Figure 5C:
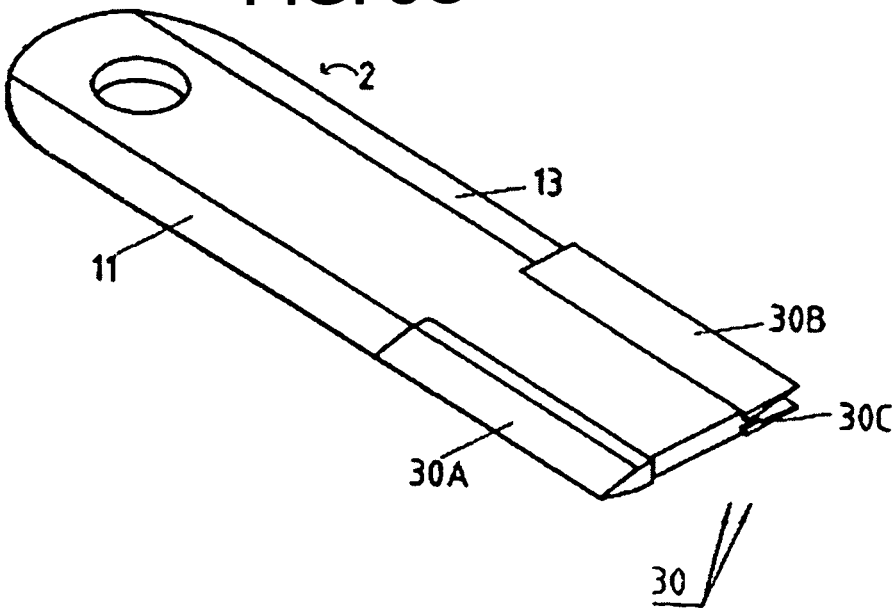
FIG. 5C shows another chopping blade with various hard-metal cutting inserts.
Figure 6:
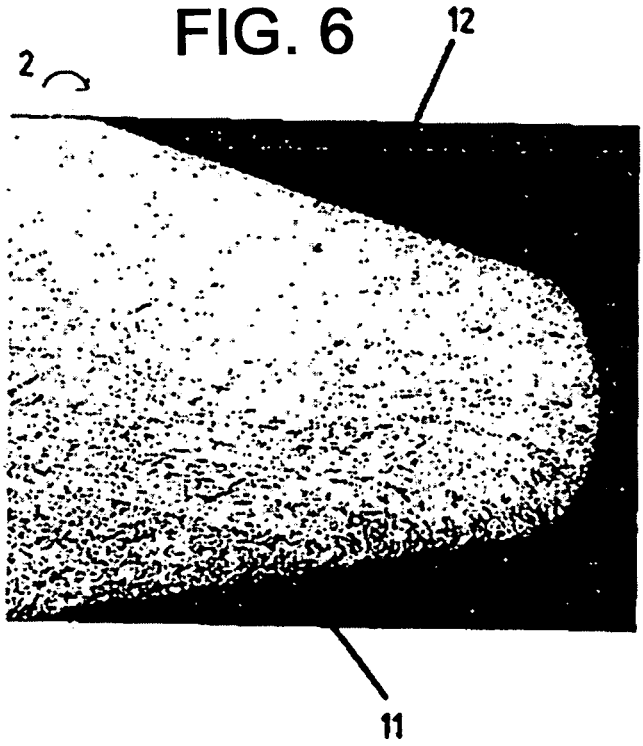
Figure 7:
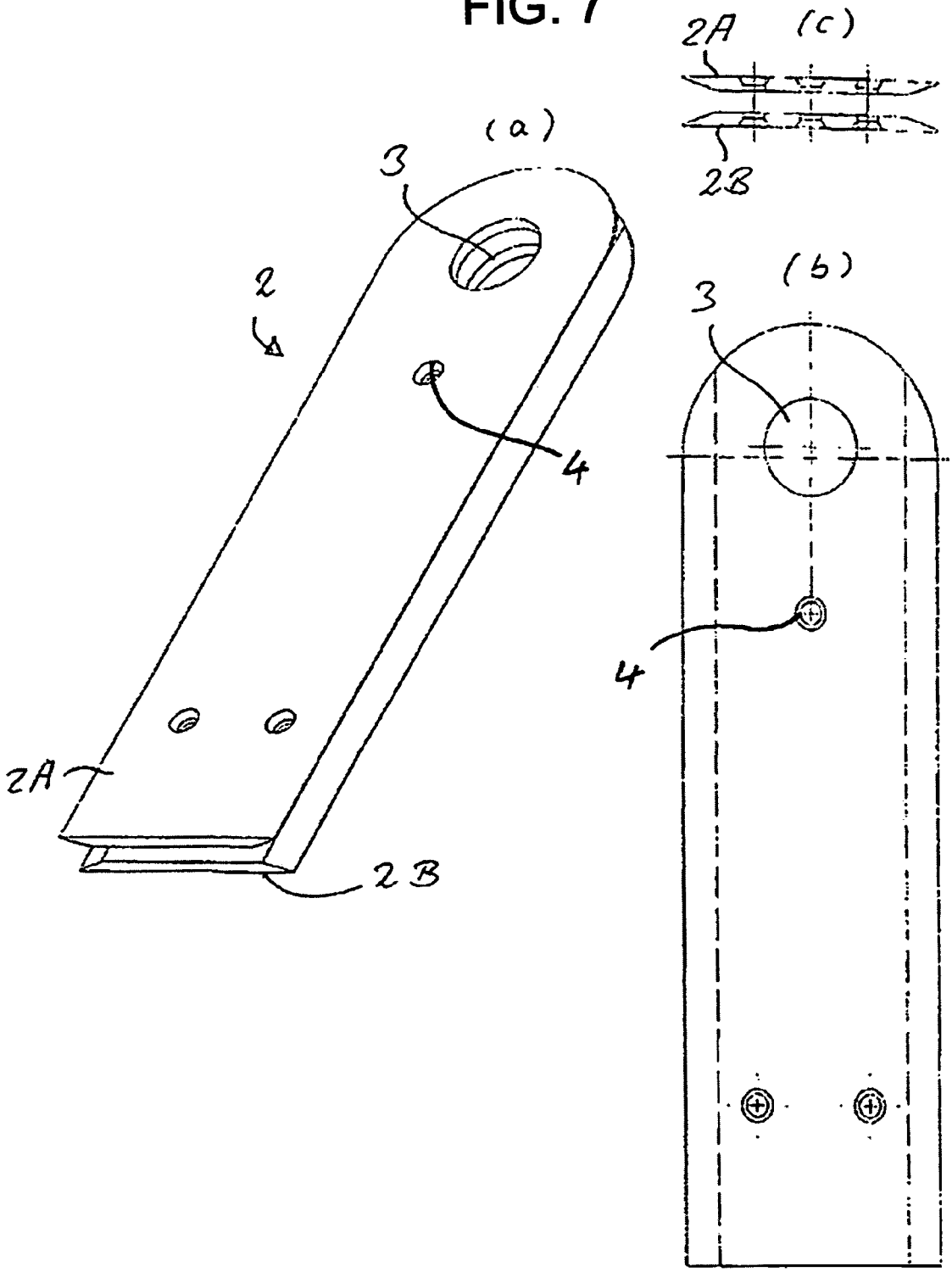
Figure 8:
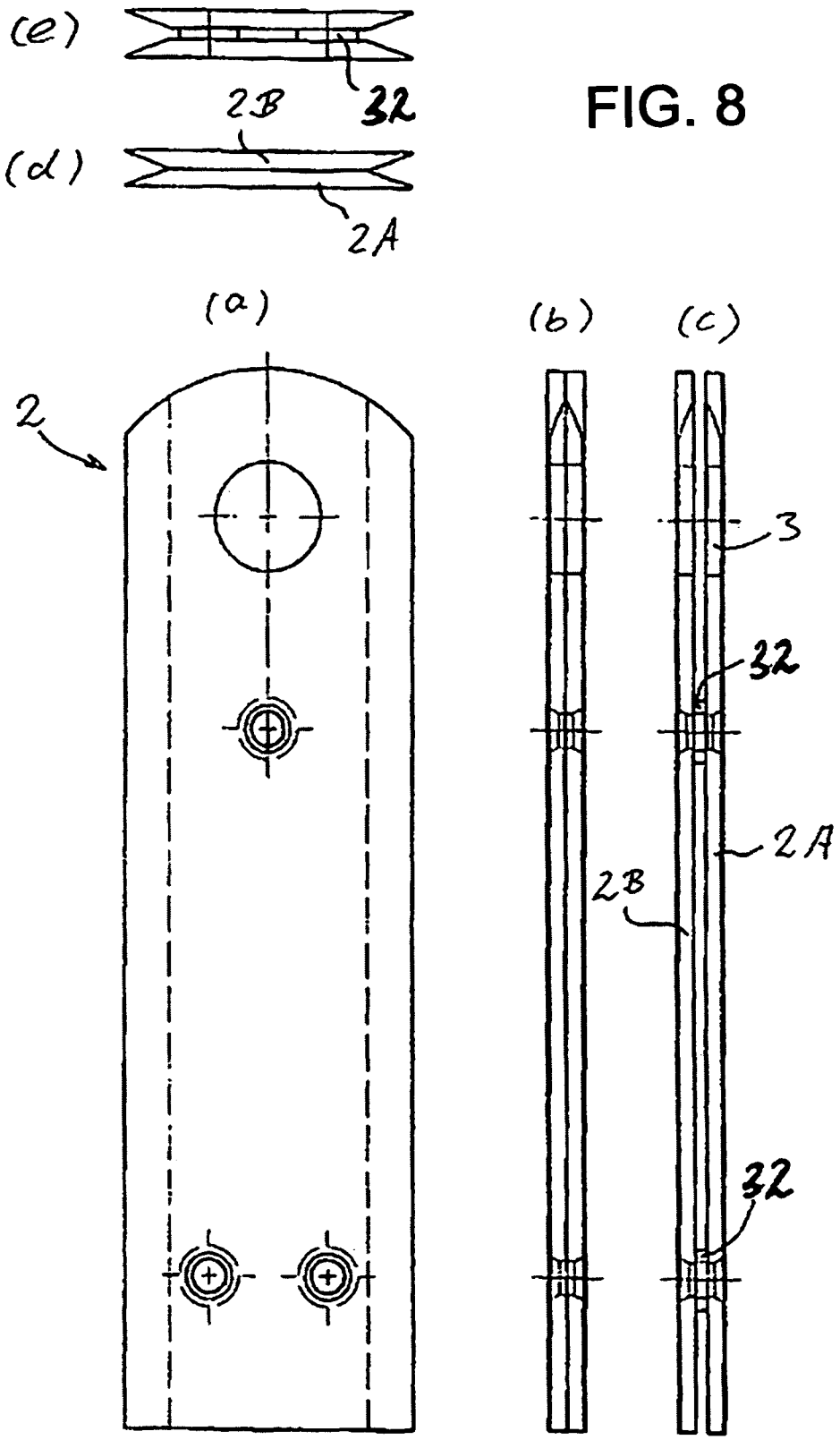

FIG. 5C shows a chopping blade 2 with hard-metal pieces or inserts 30 installed on a portion of the prismatic cutting edges of the blade 2. By way of example, a single hard-metal cutter 30A and a double hard-metal cutter 30B, 30C are shown in the tip area. This latter type of cutter can replace the double-leaf chopping blade illustrated below in FIGS. 7 and 8. FIG. 6 shows an inventive prismatic cutter formed by rolling to produce satisfactory sharpness with a slightly rounded cutting edge with a cutting edge radius of about 0.3 mm or less, in this case, approximately 0.25 mm;

In the embodiment according to FIG. 7, the chopping blade 2 comprises two chopping blades 2A and 2B designed according to the invention. As shown in the exploded views (a) and (c), the two blades are still a certain distance apart. The two blades 2A and 2B, which are of the same design, are joined together by rivets, for example, so that they rest tightly against one another. The end portion (fastening zone) close to the hole 3, which is used to fasten the blades in position, is rounded in semi-circular fashion. In contrast, this area or zone of the chopping blade according to FIG. 8 is rounded in a lens-like manner, and the embodiments according to views (c) and (e) of FIG. 8 have spacers 32 to increase the width.

Figure 9:
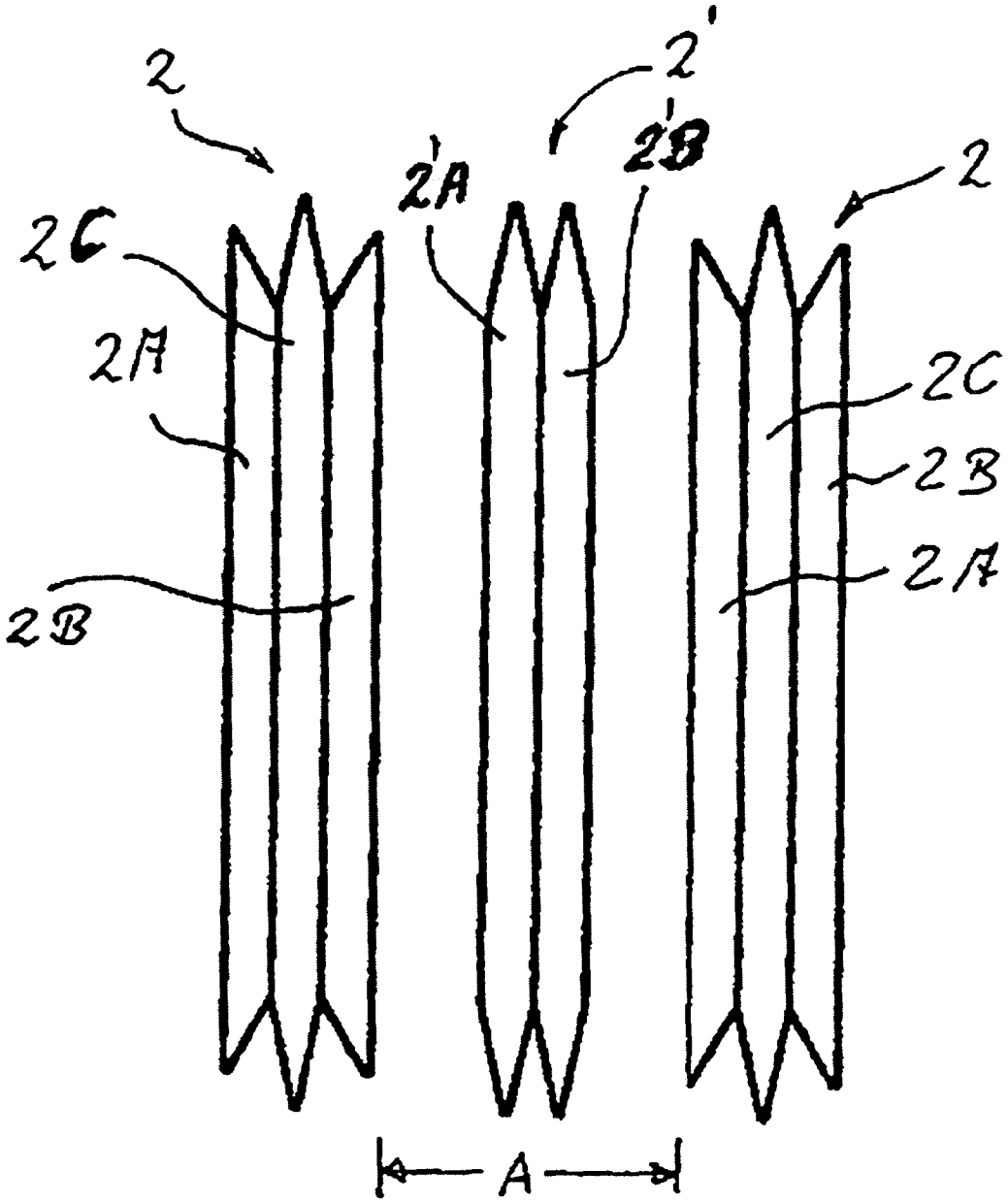

Finally, FIG. 9 shows an arrangement of chopping blades 2 in a device, in which a stationary counterblade 2' fits into the gap A between the moving chopping blades 2. The chopping blades 2 consist of packages of 3 blades each, i.e., blades 2A, 2B, and 2C, whereas the stationary counterblade consists of a package of two blades 2'A and 2'B. The chopping blades and the counterblades have several laterally spaced cutting edges, which increase the degree to which the material to be chopped is reduced in size or broken up and also improve the degree to which the surface structure of the material is destroyed.

The further chopping blade according to FIGS. 10A and 10B is a double chopping blade, which is formed as a one-piece unit out of a section of appropriate length by bending this section into the shape of a "U". The fastening end is provided with aligned fastening openings 3. A chopping blade of this type is characterized by very good resistance to twisting. As illustrated and to this extent preferred, the U-shaped bridge area 2D between the two straight, longitudinal chopping blade areas 2A and 2B is also provided with cutting edges 15', 16', which supplement the longitudinal cutting edges 15, 16. It can be seen that two parallel chopping blades, which are a certain distance apart and which are connected to each other at their free ends by a bridge area, could also be connected in some other way in the bridge area, such as by means of a spacer, which can be connected to the ends of the chopping blades by an adhesive, by welding, or by some other suitable method. These double chopping blades are also of independent inventive status even without the above mentioned features of rolling flat steel into a prismatic shape with a slightly rounded cutting edge.

The exemplary embodiments according to FIGS. 11A and 11B show that to avoid cutting waste, the ends of the blades can be complementary to each other (cut edges 34*a* and 34B). In this way, chopping blades can be obtained from a piece of flat strip without generating any waste. The material savings can be as high as approximately 8%. It can also be seen that the ends of the blades can have flanks 33. That is, the free flanks of the cutting edges 15, 16 can describe a circular blade trajectory X, from which the rest of the end area is set back. In the area of the beveled surfaces 11-14, the flanks 33 can be seen as straight undercuts forming an angle of less than 90° with the cutting edge. These types of flanks are known from metal-cutting tools. In the intermediate area of the blade, the undercut can be either concave as shown in FIG. 11A or stepped as shown in FIG. 11B.

The invention claimed is:

1. A process for producing a chopping blade for chopping devices equipped with rotating drums on which blades are mounted in a stationary or rotating manner, the process comprising:

rolling at least one longitudinal edge of a flat strip into a prismatic shape with a slightly rounded cutting edge to obtain a chopping blade with a prismatic cutting edge of satisfactory sharpness.

2. A process according to claim 1, wherein rolling the at least one longitudinal edge of the strip comprises cold-rolling.

3. A process according to claim 1, wherein rolling at least one longitudinal edge of a strip comprises rolling substantially the entire length of the strip into a prismatic shape with a slightly rounded cutting edge.

4. A process according to claim 1, further comprising:

providing a steel starting material with a rectangular cross section; and performing a cutting operation on the starting material to create the flat strip, wherein at least one longitudinal edge of the flat strip is subjected to the cutting operation prior to rolling the at least one longitudinal edge.

5. A process according to claim 1, further comprising adjusting a required cross-sectional volume of the flat strip by a metal-removing operation applied to the longitudinal edges.

6. A process according to claim 1, wherein the longitudinal edges of the flat strip are smoothed by edge rolling.

7. A process according to claim 1, wherein rolling at least one longitudinal edge of a flat strip comprises using width-calibrating rolls between successive pairs of profiling rolls to roll the at least one longitudinal edge into a prismatic shape with a slightly rounded cutting edge.

8. A process according to claim 1, wherein the cutting edge has a cutting edge radius of about 0.3 mm or less.

9. A process according to claim 1, further comprising performing a stamping step to profile a cross section of the blade.

10. A process according to claim 1, further comprising forming serrations over at least part of the length of the prismatic cutting edge after rolling.

11. A process according to claim 1, further comprising performing a zone-hardening step, the zone-hardening step being carried out over at least part of the length of the prismatic cutting edge.

12. A process according to claim 1, further comprising transversely cutting the flat strip into sections which can be processed into chopping blades, wherein the flat strip is cut into sections after rolling.

13. A process according to claim 1, further comprising installing at least one hard-metal piece on at least a portion of the prismatic cutting edge after rolling.

14. A process according to claim 1, further comprising attaching several blades to each other to form a correspondingly thicker blade package.

15. A process according to claim 1, wherein the prismatic cutting edge is contoured.

16. A process for producing a chopping blade for chopping devices equipped with rotating drums on which blades are mounted in a stationary or rotating manner, the process comprising:

providing a strip of flat starting material;

rolling at least one longitudinal edge of the strip into a prismatic shape with a slightly rounded cutting edge to produce a chopping blade having a prismatic cutting edge with a rolled texture extending over at least part of the length of the longitudinal edge; and forming a fastening zone including at least one hole in the chopping blade.

17. A process according to claim 16, wherein rolling at least one longitudinal edge of the strip comprises providing the cutting edge with a radius of about 0.3 mm or less.

18. A process according to claim 16, further comprising subjecting the at least one longitudinal edge of the starting material to a cutting operation before rolling the at least one longitudinal edge of the strip.

19. A process according to claim 16, wherein providing the strip of flat starting material comprises providing wide flat strip steel, and splitting the wide flat strip steel in a longitudinal direction.

20. A process according to claim 16, further comprising inserting at least one hard metal piece into the cutting edge near a free end of the chopping blade.

21. A process according to claim 16, further comprising performing a stamping step to profile a cross section of the blade after rolling the at least one longitudinal edge of the strip.

* * * * *